United States Patent [19]

Kling

[11] Patent Number: 5,048,203

[45] Date of Patent: Sep. 17, 1991

[54] ATHLETIC SHOE WITH AN ENHANCED MECHANICAL ADVANTAGE

[76] Inventor: Robert J. Kling, 3416 Woodford Rd., Cincinnati, Ohio 45213

[21] Appl. No.: 504,865

[22] Filed: Apr. 5, 1990

[51] Int. Cl.[5] ..... A43B 5/00; A43B 13/14

[52] U.S. Cl. ..... 36/32 R; 36/25 R; 36/59 C

[58] Field of Search ..... 36/32 R, 59 C, 102, 36/103, 114, 25 R

[56] References Cited

U.S. PATENT DOCUMENTS

| | | | |
|---|---|---|---|
| D. 288,027 | 2/1987 | Tonkel | 36/32 R |
| D. 290,660 | 7/1987 | Selbiger | 36/32 R |
| 500,385 | 6/1893 | Hall | 36/103 |
| 4,026,044 | 5/1977 | Senter | 36/25 R |
| 4,132,016 | 1/1979 | Vaccari | 36/114 |
| 4,378,643 | 4/1983 | Johnson | 36/59 C |
| 4,439,936 | 4/1984 | Clarke et al. | 36/32 R |
| 4,559,723 | 12/1985 | Hamy et al. | 36/59 C |
| 4,559,724 | 12/1985 | Norton | 36/59 C |
| 4,562,651 | 1/1986 | Frederick et al. | 36/59 C |
| 4,624,062 | 11/1986 | Autry | 36/59 C |

FOREIGN PATENT DOCUMENTS

| | | | |
|---|---|---|---|
| 428974 | 1/1948 | Italy | 36/59 C |

*Primary Examiner*—Steven N. Meyers

*Attorney, Agent, or Firm*—Charles R. Wilson

[57] ABSTRACT

An athletic shoe comprises an upper member and a sole member. The sole member is characterized in having a substantially flat bottom surface, a lateral channel in the sole's bottom surface at the metatarsal area of the user's foot, and a set of inwardly concave longitudinally extending channels in the sole's bottom surface. A plurality of vertically extending grooves in the sole member's side walls are provided in a preferred embodiment. The structural features in the sole member impart a mechanical advantage to the user of the athletic shoe while not impairing the comfort of the shoe.

8 Claims, 3 Drawing Sheets

ATHLETIC SHOE WITH AN ENHANCED MECHANICAL ADVANTAGE

This invention relates to an athletic shoe. More particularly, the invention relates to an athletic shoe with a sole member having unique structural features to give a mechanical advantage to the user.

Athletic shoes are increasing in popularity. Most are made of leather and vinyl, though other materials are also being increasingly used. Many of the shoes available are specially constructed depending on the user's anticipated activity. Thus, there are shoes commercially available which are designed specifically for use in playing football, soccer, basketball, tennis and other competitive sports as well as shoes designed for casual jogging and walking. The uniqueness of each shoe is normally in its sole construction. The bottom of the sole in particular is configurated in various ways which the manufacturer feels will provide some advantage to the user. For instance, the sole bottom may have certain shaped grooves or indentations positioned in a certain way to give better traction to the shoe. Other shoes have been sold where the sole bottom has a lateral groove extending across the sole's bottom surface to aid in its flexing and, presumably, comfort (see U.S. Pat. No. 4,309,832).

Many athletic shoes are constructed to give the user a cushioning effect in an attempt to relieve the effects of external forces resulting from the strains experienced in many sports. Special sole materials with excellent resiliency factors have been used. Additionally, soles have been constructed with added features such as air pockets designed to trap air and a leaf spring. U.S Pat. Nos. 4,451,994 4,624,062 and 4,638,575 contain examples of athletic shoes wherein a special construction have been suggested to improve cushioning of the user's foot.

Comfort is a feature which all athletic shoes must have in addition to any performance advantage the shoes may possess. The shoe must fit properly and must not add strain to any of the several foot muscles. Several shoe designs have been sold with comfort as their main selling point. These shoes have primarily focused on improved soles and sole inserts for added cushioning.

In accord with a need for an improved athletic shoe wherein performance and comfort are both enhanced, there has been developed a shoe with a set of unique structural features. Features included in a sole member of the shoe collectively impart a noticeable mechanical advantage to the shoe's user. Other features are added to the upper member and sole member of the shoe for comfort and appearance purposes. The resultant athletic shoe is economically produced and enjoys many benefits lacking in known shoe designs.

SUMMARY OF THE INVENTION

An athletic shoe is constructed for an added mechanical advantage it gives to the user as well as for comfort. The shoe comprises an upper member and a sole member. The sole member is characterized in having a substantially flat bottom surface, a lateral channel in the sole's bottom surface extending across the metatarsal area of the user's foot, and a set of longitudinally running inwardly concave channels in the sole's bottom surface extending from about the lateral channel to the sole member's forward extremity. In a preferred embodiment of the invention a plurality of vertically extending grooves in an outside side wall of the sole member are substantially equi-spaced from about the head of the metatarsal area to the base of the metatarsal area of the user's foot.

DETAILED DESCRIPTION OF THE INVENTION

Figure 1:
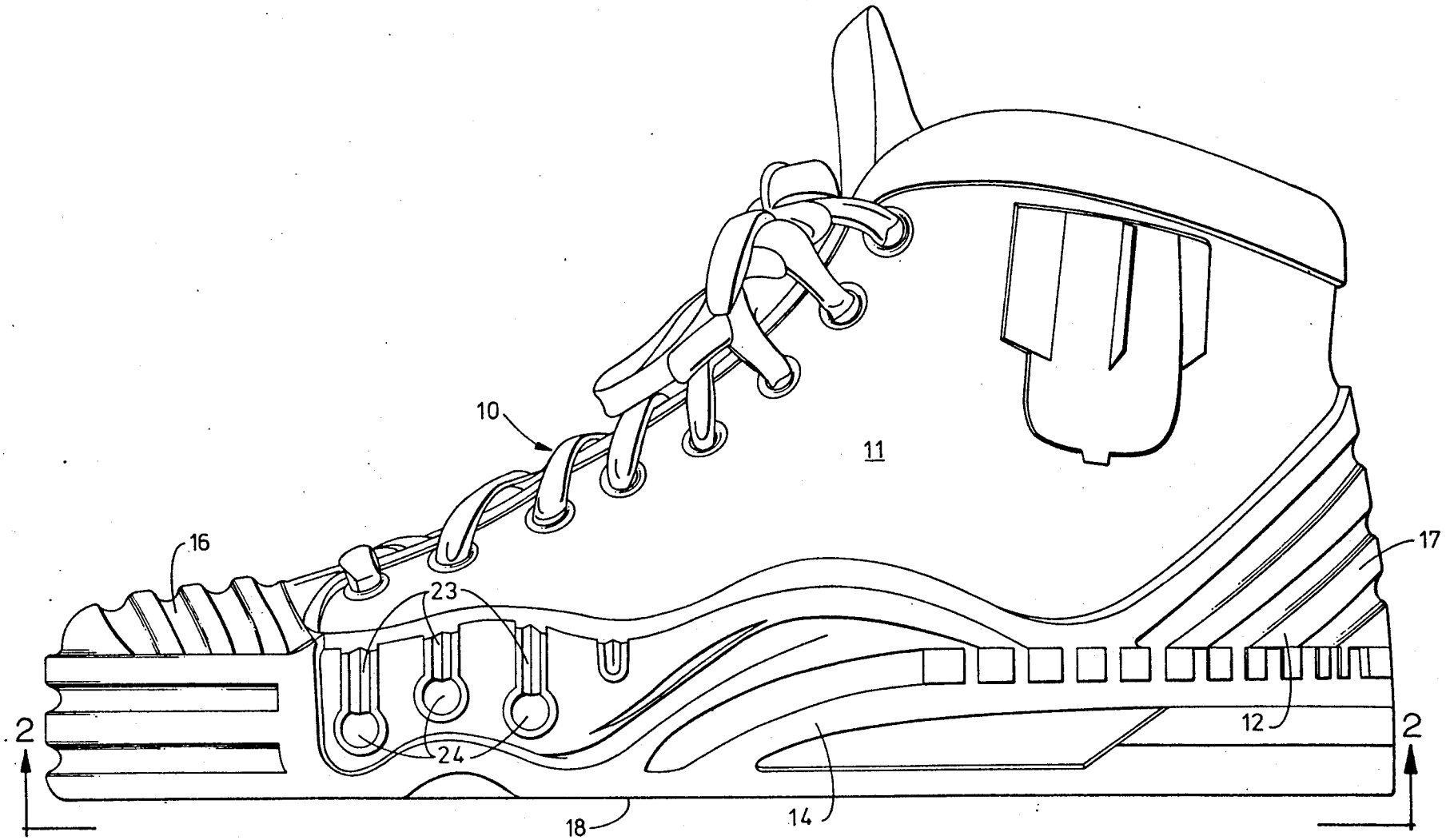
FIG. 1 is a side view of the athletic shoe of this invention showing the instep area of the shoe.

With reference to FIG. 1, there is shown an athletic shoe 10. The shoe comprises an upper member 11 and a sole member 12. The upper member is preferably made of a pre-shrunk canvas material and is shaped to comfortably cover the user's upper foot and ankle. Other materials which can be used in its construction are non-shrinkable and include materials such as nylon and polypropylene. As discussed below, more expensive materials can be used in this part of the shoe because of the cost savings from the one piece molded sole member. The particular structural features of the upper member are conventional in nature. The upper member is sewn directly to the sole member.

Figure 3:
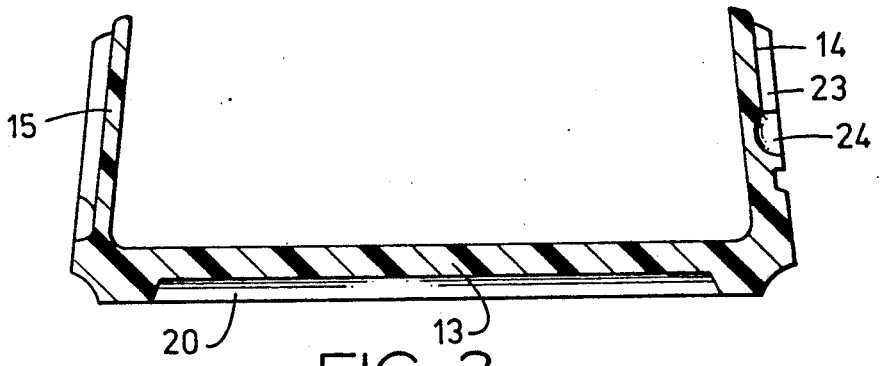
FIG. 3 is a sectional view taken along line 3—3 of FIG. 2 showing a cross section of a lateral channel found in the sole member of the shoe.
Figure 4:
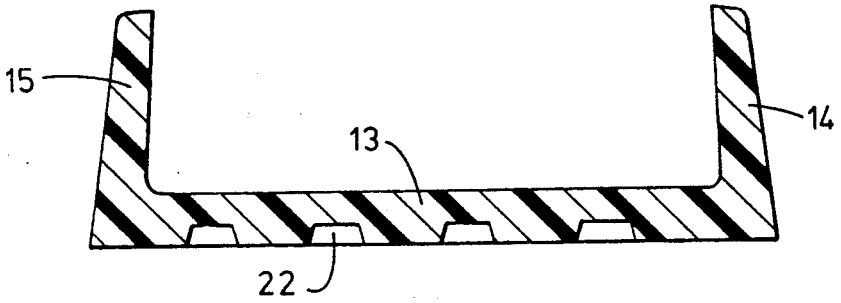
FIG. 4 is a sectional view taken along line 4—4 of FIG. 2 showing a cross section of one of the longitudinally running channels found in the sole member of the shoe.
Figure 5:
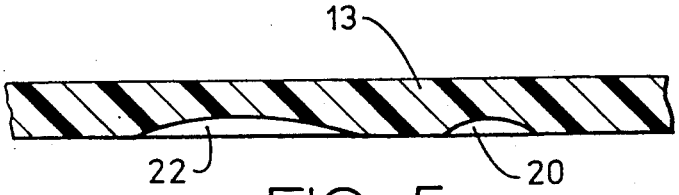
FIG. 5 is a sectional view taken along line 5—5 of FIG. 2 showing a profile of a longitudinally running channel in the sole member of the shoe.
Figure 6:
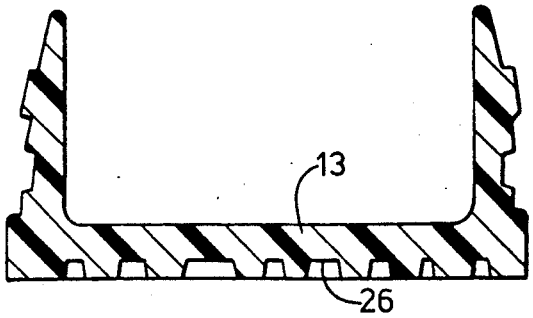
FIG. 6 is a sectional view taken along line 6—6 of FIG. 2 showing a cross-section of a heel area of the sole member of the shoe.

The sole member 12 has a number of structural features which collectively enhance the performance of the shoe. The sole member is generally U-shaped in its cross-dimension as evident in FIGS. 3, 4 and 6. It is of one-piece construction and is designed to receive the user's foot with sufficient room for the expansion needed in running and jumping. The sole member 12 has a bottom wall 13, an inside side wall 14 and an outside side wall 15 which extend substantially vertically from the bottom wall, a forward toe wall 16 extending from the bottom wall and dimensioned to substantially encompass the toes of the shoe's user, and a rearward heel wall 17 extending from the bottom wall and dimensioned substantially to encompass the heel of the shoe's user.

As evident in FIG. 1, the sole member's bottom wall 13 has an outside bottom surface which is substantially flat throughout its length. The flat surface 18 is important towards obtaining a shoe with the desired characteristics in that other structural features discussed below are dependent on the substantially flat surface.

Figure 2:
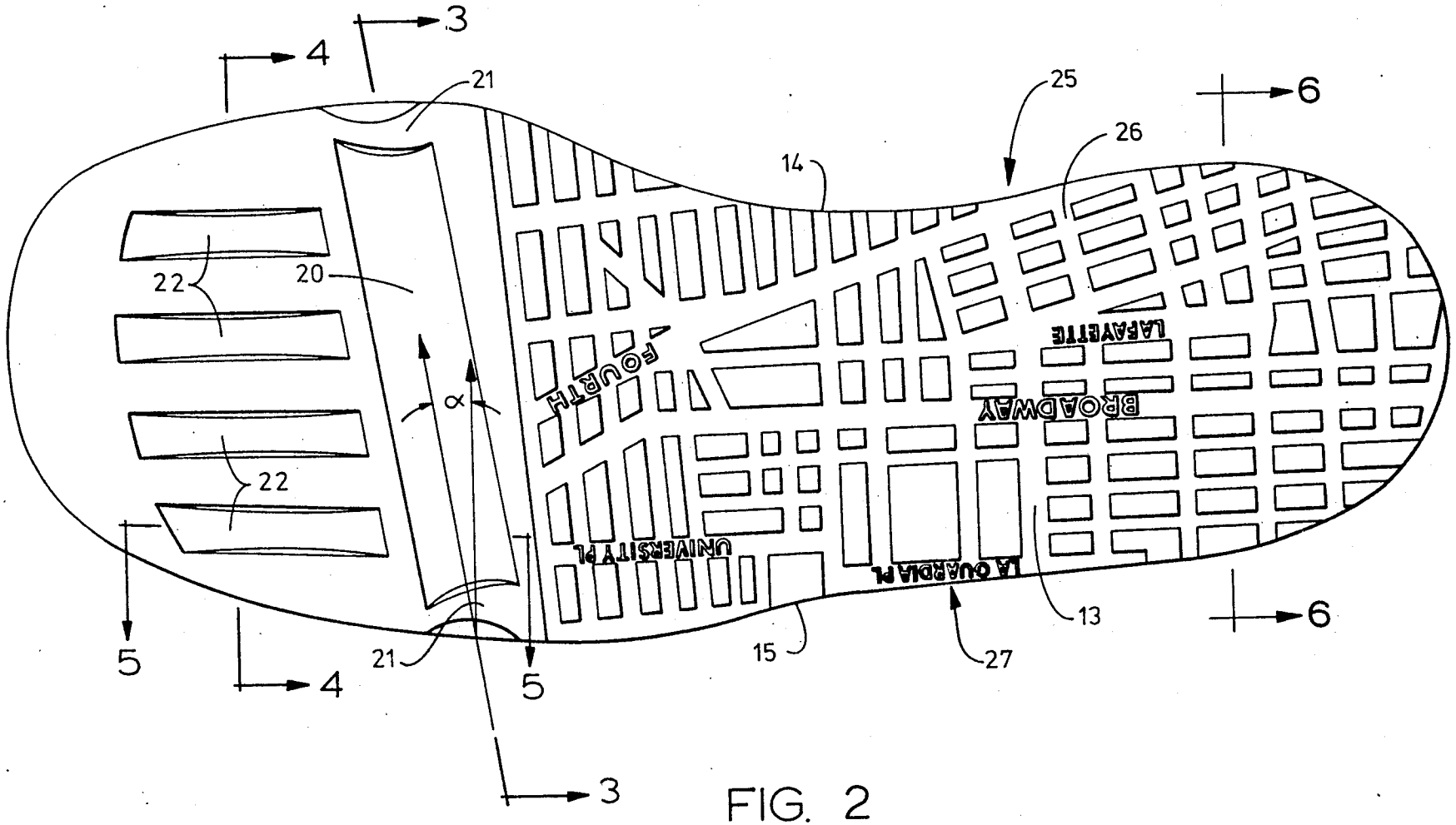
FIG. 2 is a bottom view of the athletic shoe of FIG. 1.

As can be seen in FIG. 2, the sole member has a lateral channel 20 in the surface of its bottom wall 13 which extends substantially across the sole at the metatarsal area of the user's foot. The lateral channel is in the mid-section of the sole member's bottom wall. It does not extend to the periphery of the sole member, though does approach it on both sides with a narrow land area 21 at each end of the channel. The channel is approximately centered across the width of the sole member and preferably extends at least at about 80% of the sole member's width. Additionally, the channel 20 is angled from the longitudinal axis of the sole member to match the natural bending area of the user's foot. Preferably, the channel is angled from about 5 degrees to about 10 degrees from the perpendicular as extended from the sole member's longitudinal axis. The depth of the channel is from about 0.06 inches to about 0.20 inches at its deepest point. The channel shown has an inverted concave shape running laterally, though other shapes of channels can also be used. It has been found the channel when shaped and positioned in the required manner acts like a leaf spring to actually aid the user in running and jumping.

A set of longitudinally running inwardly concave channels 22 are also found in the surface of the sole member's bottom wall. The channels extend from near the lateral channel 20 to the sole member's forward extremity. Each channel has substantially vertical side edges and a concave-shaped depression extending into the bottom wall 13. From two to five, preferably two to three, channels are provided. Each channel is about 0.03 inches to about 0.50 inches wide, about 1.50 inches to about 1.75 inches long and point.

A plurality of vertically extending grooves 23 are optionally provided in the sole member. The grooves are found in both side walls of the sole member and extend from near the sole member's bottom surface to near its top surface. The grooves are substantially equispaced in the side walls from about the head of the metatarsal area to about the base of the metatarsal area. From two to five grooves on each side wall provide a noticeable benefit with two to four grooves being optimum for performance reasons. It has been found the vertically extending grooves aid in the forward flexing of the shoe as will occur naturally when worn. A round indentation 24 at the lower end of each of the grooves is to induce a substantially even dissipation of stress vectors resulting from a compression of the sole member's material of construction during the shoe's use. In effect the shoe collapses better during use and thus expands most efficiently.

The sole member 12 is a one piece construction produced by an injection molding process. The particular shape requirements of the sole member are most economically provided by using a molding process. Any moldable polymeric material is used. A high memory polyurethane is one material which provides a balance of cost, moldability, and wearability which makes it preferred.

The athletic shoe of the invention which comprises the upper member and the above described sole member has a mechanical advantage over known shoes which makes it particularly desirable. It has been found that the structural features of the sole member collectively combine to give an effect which closely resembles that obtained from a leaf spring. The mechanical advantage from the shoe results in the user of the shoe being able to maximize his running and jumping abilities. The benefits are enjoyed while comfort is enhanced.

Other optional features can be molded into the sole member to enhance the marketability of the athletic shoes. For example, the bottom gripping surface of the sole member can be configured as a three dimensional molded street map of geographic features. The map 25 shown in FIGS. 2 and 6 has depressed street channels 26 with raised street lettering 27 in the street channels. Additionally, a groove design can be provided on the upper member in the toe area and the heel area to act as protective bumpers. A more box-like toe area provides for increased big toe room, and hence, more comfort. Still other design features can be added without diminishing the effects of the unique features of the invention.

While the invention has been described in detail with reference to the drawings, it should be understood several variations of the shoe are possible. All obvious modifications to the described athletic shoes are considered to be within the scope of coverage of the appended claims.

What is claimed is:

1. An athletic shoe constructed for comfort and to give a mechanical advantage to its user, said shoe comprising:

(a) an upper member; and (b) a sole member connected to the upper member, said sole member characterized in having (i) a substantially flat bottom surface throughout its length, (ii) a lateral inwardly concave channel in the bottom surface extending substantially across the metatarsal area of the user's foot, (iii) a set of longitudinally running inwardly concave channels in the sole's bottom surface extending from near the lateral channel to near the sole member's forward extremity, and (iv) a plurality of vertically extending grooves in both walls of the sole member extending from about the head of the metatarsal area to about the base of the metatarsal area of the user wherein each of the vertically extending grooves further has a round indentation at the lower end of the indentation to induce a substantially equal dissipation of stress vectors resulting from a compression of the sole member during use.

2. The athletic shoe of claim 1 wherein the sole member is of one piece construction molded from a synthetic polymeric material.

3. The athletic shoe of claim 2 wherein the upper member s made from a pre-shrunk canvas material to aid in maintaining the sole member in a substantially flat shape.

4. The athletic shoe of claim 2 wherein the upper member is made from a non-shrinkable material to aid in maintaining the sole member in a substantially flat shape.

5. The athletic shoe of claim 2 wherein the lateral channel in the sole member's bottom surface is from about 0.06 inches to about 0.20 inches in depth at its deepest point.

6. The athletic shoe of claim 5 wherein there are two to five substantially equi-spaced longitudinally running inwardly concave channels in the sole member's bottom surface.

7. The athletic shoe of claim 1 wherein the lateral channel is angled from about 5 degrees to about 10 degrees from the perpendicular as extended from the sole member's longitudinal axis.

8. The athletic shoe of claim 1 wherein there are two to five vertically extending grooves on each side wall of the sole member.

* * * * *